US011556091B2

(12) United States Patent
Aoba et al.

(10) Patent No.: US 11,556,091 B2
(45) Date of Patent: Jan. 17, 2023

(54) TIMEPIECE

(71) Applicant: CITIZEN WATCH CO., LTD., Tokyo (JP)

(72) Inventors: Kaori Aoba, Higashiyamato (JP); Yasushi Tomiyama, Abiko (JP); Hideki Inoue, Musashino (JP)

(73) Assignee: Citizen Watch Co., Ltd., Tokyo (JP)

( * ) Notice: Subject to any disclaimer, the term of this patent is extended or adjusted under 35 U.S.C. 154(b) by 998 days.

(21) Appl. No.: 16/284,547

(22) Filed: Feb. 25, 2019

(65) Prior Publication Data

US 2020/0272104 A1 Aug. 27, 2020

(51) Int. Cl.

| | |
|---|---|
| ***G04B 19/10*** | (2006.01) |
| ***G04B 19/08*** | (2006.01) |
| ***G04B 19/06*** | (2006.01) |

(52) U.S. Cl.

CPC ..... *G04B 19/10* (2013.01); *G04B 19/065* (2013.01); *G04B 19/08* (2013.01)

(58) Field of Classification Search

CPC ..... G04B 19/10; G04B 19/08; G04B 19/065

USPC ..... D10/39, 123

See application file for complete search history.

(56) References Cited

U.S. PATENT DOCUMENTS

| | | | | |
|---|---|---|---|---|
| 6,295,251 | B1 * | 9/2001 | Sakai | G04B 19/065 368/232 |
| 2011/0103199 | A1 * | 5/2011 | Winkler | G04B 37/0008 29/896.3 |
| 2019/0086871 | A1 * | 3/2019 | Okamura | G04B 19/12 |

FOREIGN PATENT DOCUMENTS

| | | | |
|---|---|---|---|
| CH | 515540 | A | 7/1971 |
| FR | 01121312 | A | 8/1956 |
| JP | 2004-184197 | A | 7/2004 |
| JP | 2007-124011 | A | 5/2007 |
| JP | 2015-169480 | A | 9/2015 |

OTHER PUBLICATIONS

Office Action issued in Japanese Patent Application No. 2016-163985, dated Jun. 2, 2020, with English translation, in 7 pages.

* cited by examiner

*Primary Examiner* — Edwin A. Leon
*Assistant Examiner* — Jason M Collins
(74) *Attorney, Agent, or Firm* — Knobbe, Martens, Olson & Bear, LLP

(57) ABSTRACT

A timepiece includes a dial plate including a first index on a radial virtual line outwardly extending from a center; and a circular case ring disposed outside of the dial plate, the circular case ring including a second index arranged in series with the first index on the line, wherein the second index includes a proximal end facing the first index; and a distal end opposite the proximal end, wherein a width of the proximal end is wider than that of the distal end in a plan view as seen in a height direction of the dial plate, and wherein the width of the proximal end of the second index is wider than that of a proximal end of the first index facing the second index.

20 Claims, 7 Drawing Sheets

TIMEPIECE

FIELD OF THE INVENTION

The present disclosure relates to a timepiece.

BACKGROUND

A timepiece indicates time by pointing at markers or indicators with hands such as an hour hand and a minute hand. The markers include smaller markers disposed in positions which are separated each other with one-minute intervals (corresponding to one minute of the minute hand which rotates once in every sixty minutes) and larger markers (hereinafter referred to as indices) disposed in positions which are separated each other with five-minute intervals (corresponding to one hour of the hour hand which rotates once in every twelve hours).

In addition to the markers or indices on a dial plate, the indices may be disposed on a circular member such as a case ring which is provided on the outer circumferential part of the dial plate or in a position outward from the dial plate. Further, the indices may be disposed both on the dial plate and the circular member. In the timepiece where the indices are disposed both on the dial plate and the circular member, the indices of the dial plate and the indices of the circular member are arranged in series on a line which radially extends from the center (the rotational center of the hands) of the dial plate, which gives a viewer or user an impact in terms of its design (see Patent Literature 1: JP2007-124011A, for example).

The dial plate and the circular member are separate parts, so that the dial plate and the circular member may be displaced or misaligned relative to each other when the timepiece is assembled. For example, after the dial plate is fixed to a case of the timepiece, the circular member is placed within the case and then a grass or crystal is fixed to the case. A waterproof seal is generally provided between the crystal and the case. When the crystal is fixed to the case, the crystal is compressed into the case, which elastically deforms the seal. At this time, the movement of the crystal and the seal slightly rotates the circular member unexpectedly.

As a result, the indices of the dial plate and the indices of the circular member, which are supposed to be arranged in series on the line radially extending from the center of the dial plate, are displaced or misaligned relative to each other in a rotational direction (circumferential direction). The indices of the dial plate and the indices of the circular member may also be displaced relative to each other as described above due to machining accuracy of the circular member, the indices on the circular member and the like even if another positioning structure is used for the circular member. The displacement or misalignment between the indices on the dial plate and the indices on the circular member deteriorates quality in the appearance of the timepiece.

The present disclosure has been made in view of the above issues, and accordingly an object of the present disclosure is to provide a timepiece which can suppress deterioration of quality in the appearance of the timepiece even if the indices on the dial plate and the indices on the circular member are displaced or misaligned relative to each other.

SUMMARY OF THE INVENTION

A timepiece of the present disclosure includes a dial plate including a first index on a radial line outwardly extending from a center; and a circular member disposed outside of the dial plate and extending at least partially circularly, the circular member including a second index arranged in series with the first index on the radial line, wherein the second index includes a proximal end facing the first index and a distal end opposite the proximal end, wherein a width of the proximal end is wider than that of the distal end in a plan view as seen in a height direction of the dial plate, and wherein the width of the proximal end of the second index is wider than that of a proximal end of the first index facing the second index.

DETAILED DESCRIPTION

Figure 1:
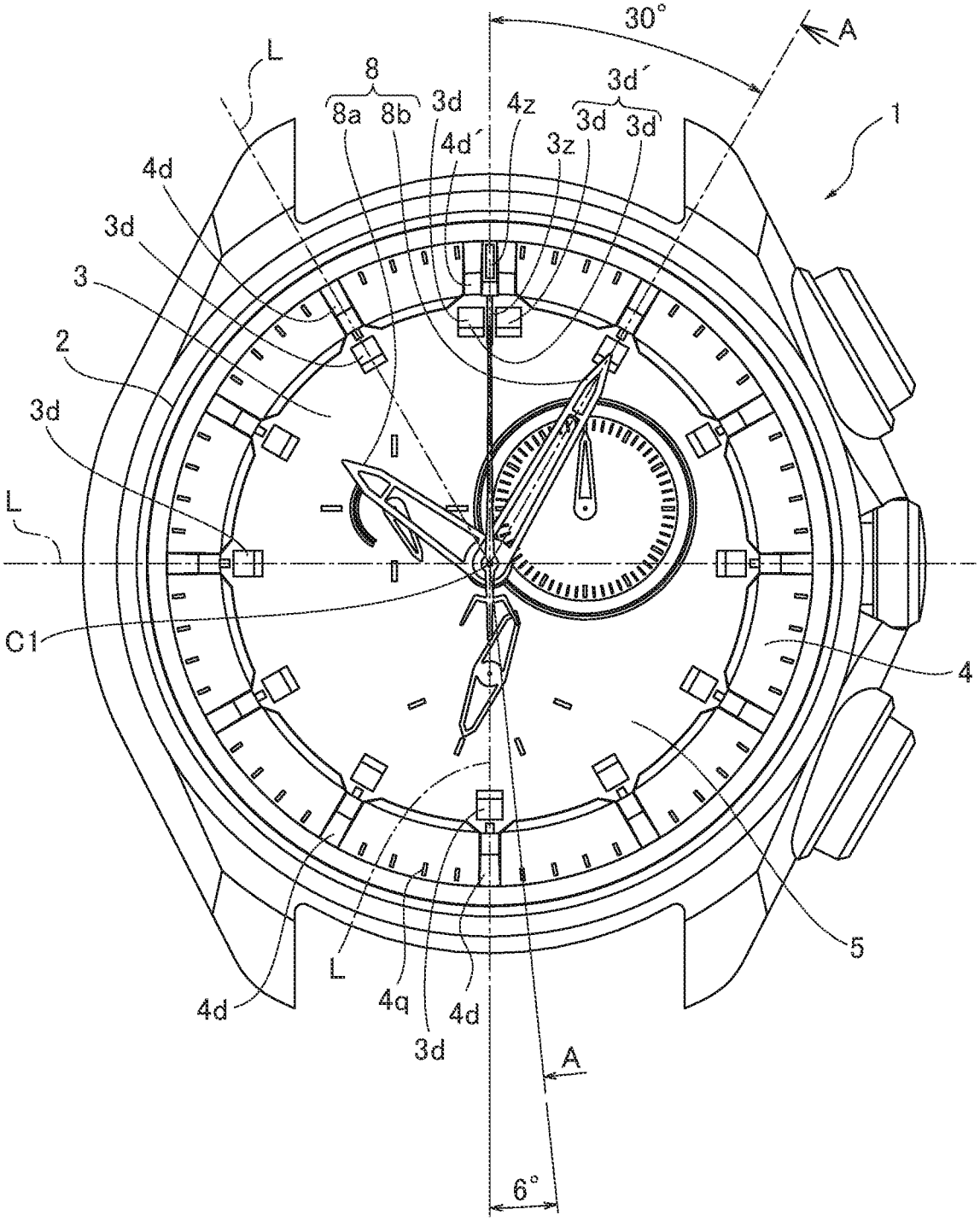
FIG. 1 is a plan view illustrating a wristwatch according to an embodiment of the present disclosure.
Figure 2:
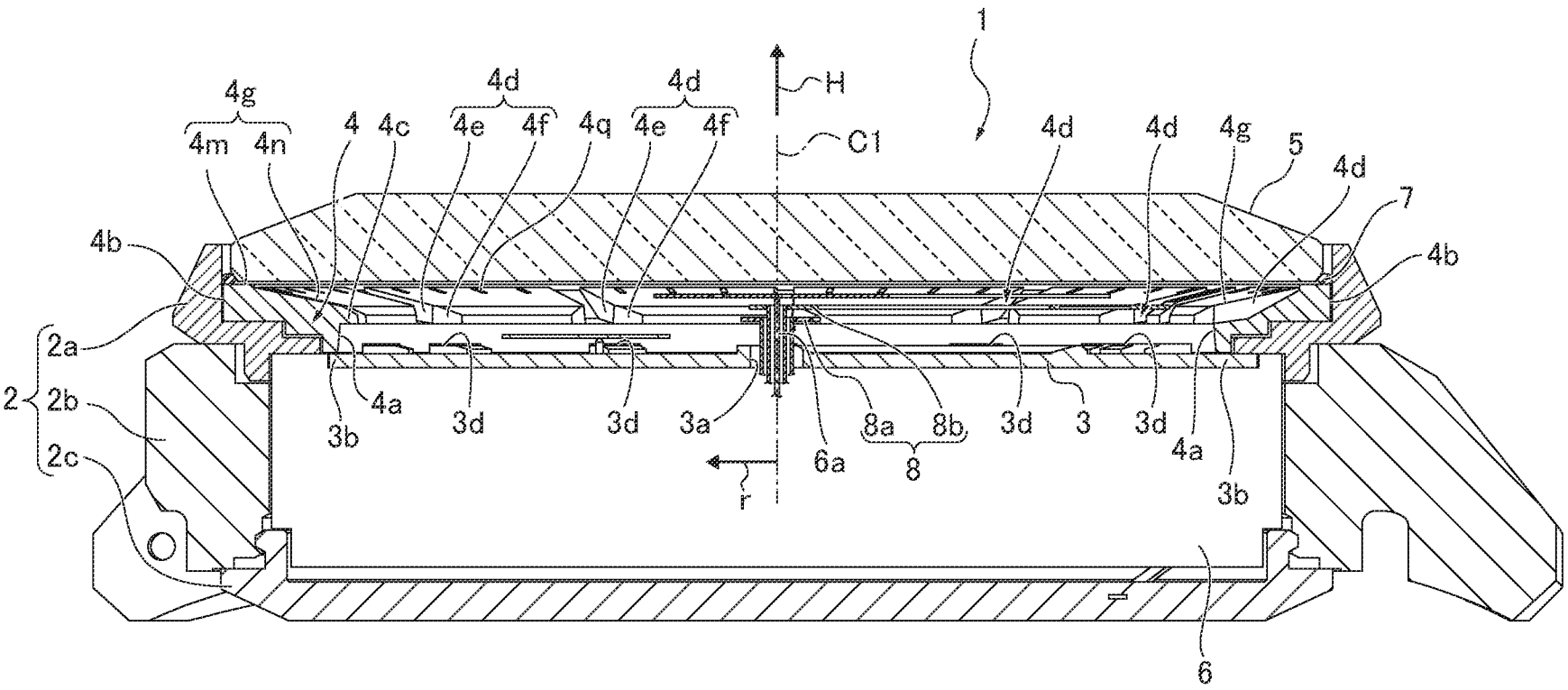
FIG. 2 is a cross-sectional view along a line A-A in FIG. 1.

Hereinafter, embodiments of a timepiece according to the present disclosure will be described with reference to the accompanying drawings. FIG. 1 is a plan view illustrating a wristwatch 1 according to an embodiment of the present disclosure. FIG. 2 is a cross-sectional view along a line A-A in FIG. 1. The wristwatch 1 includes a case 2, a grass or crystal 5, a movement 6, a dial plate 3, a dial ring or case ring 4 (an example of a circular member), and a hand 8 (including a hour hand 8*a* and a minute hand 8*b*). The wristwatch 1 includes smaller hands for functions different from the time display function. However, the smaller hands will not be described since such hands do not directly relate to the present disclosure.

The case 2 includes an upper circular portion 2*a*, a lower circular portion 2*b* provided in a position below the upper circular portion 2*a*, and a back cover or case back 2*c* attached to the lower circular portion 2*b*. The movement 6 is placed within a space defined by the lower circular portion 2*b* and the case back 2*c*.

The dial plate 3 is disposed in the upper side of the movement 6. The case ring 4 is formed in an uninterrupted circular form. The case ring 4 is disposed in a position above an outer portion 3*b* of the dial plate 3 and inside the upper circular portion 2*a* to cover the outer circumferential edge of the dial plate 3. The crystal 5 is disposed in a position above the case ring 4 and inside the upper circular portion 2*a* with a seal 7 disposed between the crystal 5 and the upper circular portion 2*a*. The seal 7 also contacts to the case ring 4. The seal 7 is made of an elastic material for waterproofing.

The dial plate 3 includes a center opening 3*a* in a center C1 through which a rotating shaft 6*a* extending from the movement 6 extends. The hour hand 8*a* and the minute hand 8*b* are fixed to the rotating shaft 6*a*. The center C1 is coincident with the geometric center of the dial plate 3 in the wristwatch 1 of the present embodiment. However, the center C1 may not be necessarily the geometric center of the dial plate 3 as long as the center C1 is the rotational center of the hand 8. The hour hand 8*a* rotates about the center C1 once in every twelve hours, and the minute hand 8*b* rotates about the center C1 once in every sixty minutes.

The dial plate 3 includes a plurality of indices 3*d* (an example of first indices or index, hereinafter referred to as the first indices (index) 3*d*) for indicating time (the hand 8 points at the first indices). The first index 3*d* is disposed on a radial line L extending radially outwardly from the center C1 and the radial line L is provided every 30 degrees around the center C1. Each of the first indices 3*d* has a rectangular shape in a plan view. Pointing at the first index 3*d* by the hour hand 8*a* indicates an hour. Twelve first indices 3*d* are provided on the dial plate 3, each of which corresponds to each hour. The first index 3*d* is formed of resin, metal, mineral ore (a precious stone such as diamond, for example) or the like. The first index 3*d* is a convex portion protruding from the surface of the dial plate 3 to the crystal 5 (upward in a height direction H).

Two first indices 3*d*, 3*d* are arranged side by side in a position corresponding to twelve o'clock. Twelve o'clock has a special meaning different from other hours since the morning turns to afternoon and dates change at twelve o'clock. Accordingly, the two first indices 3*d*, 3*d* are arranged side by side to be distinguished from the indices at other hours to display the special meaning on the dial plate 3. Pointing at the middle of the two first indices 3*d*, 3*d* by the hour hand 8*a* indicates twelve o'clock. In other words, the two first indices 3*d*, 3*d* perform the function of the single first index 3*d* at twelve o'clock.

The case ring 4 is formed in a circular shape, and includes an inner circumferential surface 4*a*. As shown in FIG. 2, the inner circumferential surface 4*a* extends upwards from the dial plate 3 and inclined relative to the dial plate 3. The case ring 4 includes an eave 4*c* at the upper end of the inner circumferential surface 4*a*. The eave 4*c* radially inwardly extends in a radial direction r further from the inner circumferential surface 4*a*. In other words, the eave 4*c* is separated from the dial plate 3 in the height direction H, and extends toward the center C1 of the dial plate 3. The protruding leading edge of the eave 4*c* is an inner circumferential edge 4*h* (see FIG. 4).

The eave 4*c* is positioned above the first indices 3*d* on the dial plate 3 in the height direction H so that the eave 4*c* and the first indices 3*d* are separated from each other in the height direction H. An outer circumferential surface 4*b* of the case ring 4 faces the upper circular portion 2*a* of the case 2. The upper end of the outer circumferential surface 4*b* is located above the eave 4*c* in the height direction H. An upper surface 4*g* of the case ring 4 includes an outer portion 4*m* and an inner portion 4*n*. The outer portion 4*m* substantially horizontally extends from the upper end of the outer circumferential surface 4*b*. The inner portion 4*n* is located inside of the outer portion 4*m* in the radial direction r and inclined downward toward the eave 4*c*.

The case ring 4 includes a plurality of second indices 4*d* (an example of second indices or index). Each of the second indices 4*d* is arranged in series with the first index 3*d* on the dial plate 3 and on the radial line L extending radially from the center C1. Each of the second indices 4*d* corresponds to each of the twelve first indices 3*d* on the dial plate 3. In other words, the case ring 4 includes twelve second indices 4*d*. The second index 4*d* is disposed outside of the corresponding first index 3*d* in the radial direction r (see FIG. 2) on the radial line L. The case ring 4 further includes a plurality of third indices 4*q*. The third indices 4*q* are markers or indicators which equally divide a portion of the case ring between the adjacent two second indices 4*d*, 4*d* into five sub-portions (every 6 degrees) along the circumferential direction. The third indices 4*q* may be printed on the case ring, for example.

Figure 3:
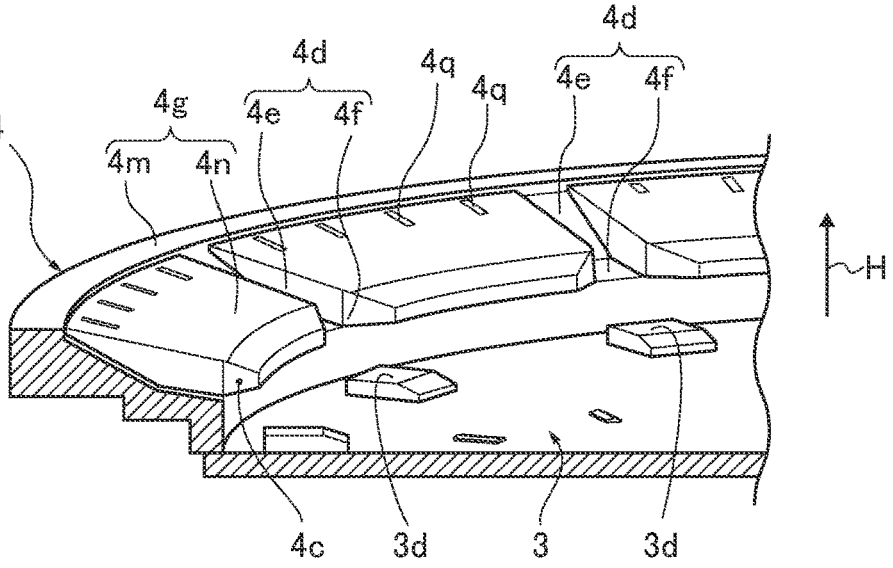
FIG. 3 is a perspective view illustrating a second index in a case ring.
Figure 4:
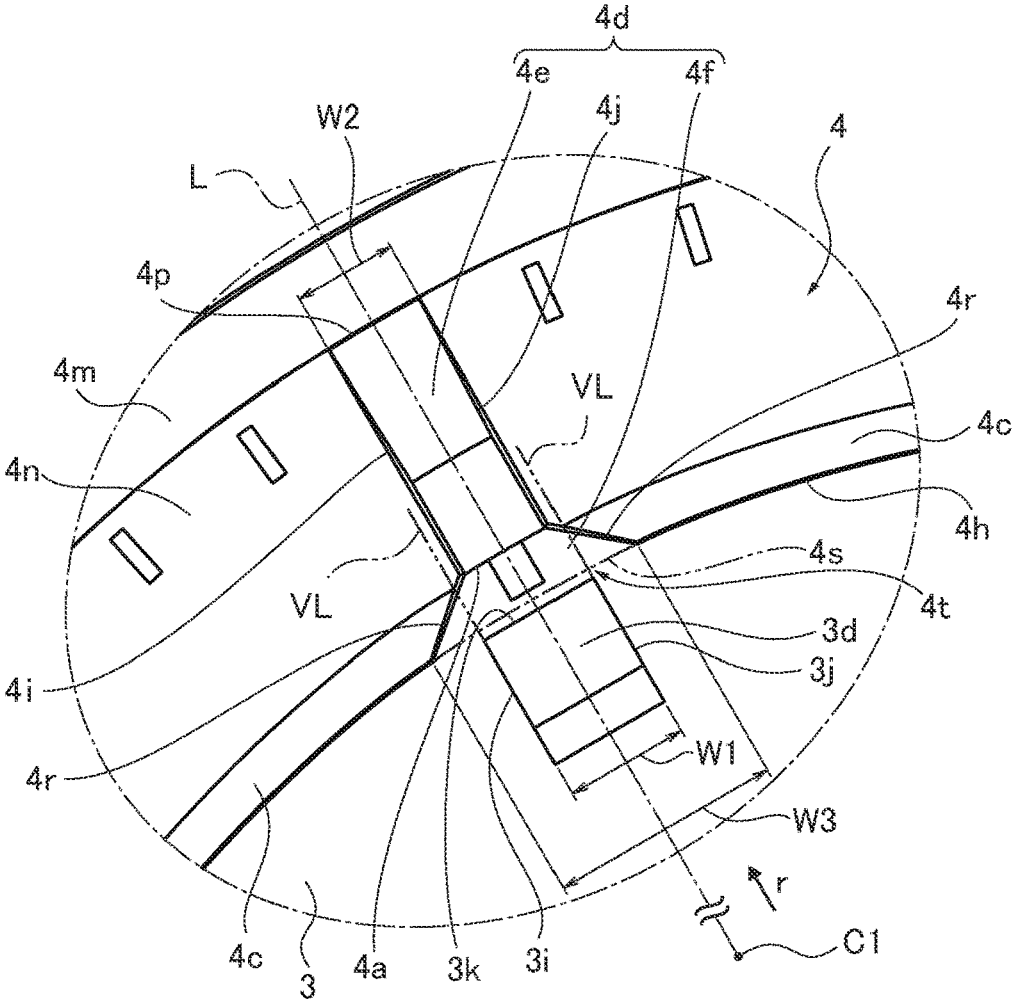
FIG. 4 is a plan view illustrating a first index and the second index.

FIG. 3 is a perspective view illustrating the second indices 4*d* in the case ring 4. FIG. 4 is a plan view illustrating the first index 3*d* and the second index 4*d*. As shown in FIG. 4, the second index 4*d* includes a rectangular portion 4*e* and a trapezoidal portion (a wider portion) 4*f* in a plan view seen in the height direction of the dial plate 3. The rectangular portion 4*e* is disposed outward in the radial direction r, and the trapezoidal portion 4*f* is disposed inward in the radial direction r. The rectangular portion 4*e* has an elongate rectangular shape in which the dimension in a direction along the radial line L is longer than the dimension in a direction perpendicular to the radial line L. At an end 4*t* close to the first index 3*d* (hereinafter also referred to as a proximal end 4*t*), the trapezoidal portion 4*f* has a wider shape in which its width gradually increases as it gets closer to the first index 3*d*.

As shown in FIG. 3, the second index 4*d* is separated from the first index 3*d* in the height direction H to be located above the first index 3*d*. In addition, as shown in FIG. 4, the second index 4*d* is disposed not to overlap the first index 3*d* in a plan view. Note that the second index 4*d* may not be separated from the first index 3*d* in the height direction H.

As shown in FIG. 3, the rectangular portion 4*e* is formed on the inner portion 4*n* as a groove which is concave relative to the upper surface 4*g* of the case ring 4. As shown in FIG. 4, the rectangular portion 4*e* is surrounded by two contour lines 4*i*, 4*j* (hereinafter referred to as radial contour lines 4*i*, 4*j*) radially extending parallel to the radial line L from the center C1 of the dial plate 3, a line to which a contour line is projected in the plan view of FIG. 4, and a boundary line 4*p* (or a distal end) which forms a boundary between the outer portion 4*m* and the inner portion 4*n* of the upper surface 4*g*.

The trapezoidal portion 4*f* is a space or cutout formed on the eave 4*c* by cutting out the eave 4*c* in the height direction H. Accordingly, the trapezoidal portion 4*f* is also concave relative to the upper surface 4*g* of the case ring 4. In the trapezoidal portion 4*f*, the line to which the contour line is projected in the plan view of FIG. 4 corresponds to an upper base or line of the trapezoid, and a line 4*s* (a line which actually does not exist since the trapezoidal portion 4*f* is the cutout, and the line is indicated by a virtual line (a two-dot chain line)) corresponds to a lower base or line of the trapezoid. The line 4*s* extends the inner circumferential edge 4*h* of the eave 4*c* to the cutout in the plan view of FIG. 4. Two contour lines 4*r*, 4*r* of the trapezoidal portion 4*f* are inclined relative to the radial line L so that the width (i.e. dimension along a direction perpendicular to the radial direction) of the trapezoidal portion 4*f* gradually increases as it gets closer to the first index 3*d*. The two contour lines 4*r*, 4*r* correspond to two inclined legs of the trapezoid (lines connecting the ends of the upper base and the ends of the lower base). The two inclined contour lines 4*r*, 4*r* of the second index 4*d* are located in a side facing the first index 3*d*.

As shown in FIG. 4, in the second index 4*d*, the width W2 of the rectangular portion 4*e*, which is further away from the first index 3*d*, is constant. Accordingly, the width of the boundary line 4*p* (i.e. a distal end of the second index 4*d*) which is an outer end of the rectangular portion 4*e* and the width (corresponding to the length of the upper base of the trapezoidal portion 40 of the inner end of the rectangular portion 4*e* also have the width W2. On the other hand, in the second index 4*d*, an end 4*t* (i.e. the proximal end 4*t*) of the trapezoidal portion 4*f* closer to the first index 3*d* has a width W3, i.e. the width of the portion corresponding to the lower base of the trapezoidal portion 4*f* (i.e. the virtual line 4*s* of the eave 4*c*). The width W3 is wider than the width W2 of the portion corresponding to the upper base (W3>W2).

The first index 3*d* includes an end 3*k* (hereinafter also referred to as a proximal end 3*k*) closer to the second index 4*d* and an end (hereinafter also referred to as a distal end) further away from the second index 4*d*. Each of the proximal end 3*k* and the distal end has a width W1 which is a dimension between two contour lines 3*i*, 3*j* (hereinafter referred to as radial contour 3*i*, 3*j*) extending parallel to the radial line L. The width W1 of the first index 3*d* is substantially the same as the width W2 of the rectangular portion 4*e* in the second index 4*d*, but the width W1 is slightly wider than the width W2 (W2<W1). In other words, the width W2 of the rectangular portion 4*e* is slightly narrower than the width W1 of the first index 3*d*.

The width W3 of the proximal end 4*t* in the second index 4*d* (i.e. that is the portion corresponding to the lower base of the trapezoidal portion 40 is wider than the width W1 of the proximal end 3*k* in the first index 3*d* (W1<W3). As a result, virtual lines VL, VL extended from the radial contour lines 3*i*, 3*j* of the first index 3*d* toward the second index 4*d* cross the inclined contour lines 4*r*, 4*r* of the second index 4*d*. In addition, the length of the second index 4*d* in the radial direction is longer than that of the first index 3*d*.

According to the wristwatch 1 configured as above, even if the displacement or misalignment between the first indices 3*d* of the dial plate 3 and the second indices 4*d* of the case ring 4 occurs (i.e. the first indices 3*d* and the second indices 4*d* are relatively displaced in the circumferential direction around the center C1), such displacement can hardly be recognized.

Specifically, with regard to the two indices, i.e. the first index 3*d* and the second index 4*d* on the radial line L, the viewer looking at the wristwatch 1 recognizes the relative displacement between the first indices 3*d* and the second indices 4*d* in the circumferential direction around the center C1 when the viewer recognizes the displacement in the circumferential direction between the radial contour line 3*i* of the first index 3*d* and the radial contour line 4*i* of the second index 4*d*, or the displacement in the circumferential direction between the radial contour line 3*j* of the first index 3*d* and the radial contour line 4*j* of the second index 4*d* as shown in FIG. 4.

In this regard, in the wristwatch 1 of the present embodiment, the contour lines 4*r*, 4*r* are provided between the radial contour line 3*i* and the radial contour line 4*i*. The contour lines 4*r*, 4*r* are located at the end of the second index 4*d* closer to the first index 3*d* and inclined relative to a direction to which the radial contour line 3*i* and the radial contour line 4*i* extend (i.e. a direction to which the radial line L extends). As a result, the viewer hardly recognizes the amount of the displacement in the circumferential direction between the virtual line VL extended from the radial contour line 3*i* of the first index 3*d* and the line extended from the radial contour line 4*i* of the second index 4*d* as well as the amount of the displacement in the circumferential direction between the virtual line VL extended from the radial contour line 3*j* of the first index 3*d* and the line extended from the radial contour line 4*j* of the second index 4*d*.

Accordingly, the viewer hardly recognizes whether the amount of the displacement between one side edge of the first index 3*d* and one side edge of the second index 4*d* (i.e. between the radial contour lines 3*i*, 4*i*) and the amount of the displacement between the other side edge of the first index 3*d* and the other the side edge of the second index 4*d* (i.e. between the radial contour lines 3*j*, 4*j*) are equal or not. Therefore, according to the wristwatch 1 of the present embodiment, the displacement can hardly be recognized by the viewer who feels that the first index 3*d* and the second index 4*d* may be displaced even when the amount of the displacement between the one side edges of the indices 3*d*, 4*d* and the amount of the displacement between the other side edges of the indices 3*d*, 4*d* are not equal. This can suppress deterioration of quality in the appearance of the timepiece due to the displacement.

Further, in the wristwatch 1 of the present embodiment, the width W3 of the portion (i.e. the proximal end 4*t*) corresponding to the lower base of the trapezoidal portion 4*f* in the second index 4*d* is wider than the width W1 of the end (the proximal end 3*k*) of the first index 3*d* closer to the second index 4*d* (i.e. W1<W3). This makes the viewer difficult to recognize the size difference between the width W1 of the first index 3*d* and the width W2 of the rectangular portion 4*e* in the second index 4*d* (i.e. whether the widths W1, W2 have the same dimension, or one of the widths is larger than the other), and accordingly, the displacement can hardly be recognized.

In the wristwatch 1 of the present embodiment, the displacement hardly occurs between the dial plate 3 and the movement 6 but may occur between the dial plate 3 and the case ring 4. In this case, the displacement hardly occurs between the hand 8 and the first indices 3*d* but may occur between the hands 8 and the second indices 4*d*. Further, in the wristwatch 1 of the present embodiment, the end (the proximal end 4*t*) of the second index 4*d* closer to the first index 3*d* has the wider shape. Accordingly, a direction at which the tip of each hand 8 is pointing comes within an area of the width W3 of the trapezoidal portion 4*f* even if the second indices 4*d* are displaced in the circumferential direction. As a result, the displacement of the second indices 4*d* relative to the hands 8 can hardly be recognized.

Further, in the wristwatch 1 of the present embodiment, the width W2 of the rectangular portion 4*e* in the second index 4*d* is narrower than the width W1 of the first index 3*d*. Accordingly, even if the both side edge (i.e. the radial contour lines 3*i*, 3*j*) of the first index 3*d* are virtually extended, such virtual lines VL, VL cross the inclined contour lines 4*r*, 4*r* of the second index 4*d*.

On the other hand, if the width W2 of the rectangular portion 4*e* in the second index 4*d* is slightly wider than the width W1 of the first index 3*d*, and the both side edge (i.e. the radial contour lines 3*i*, 3*j*) of the first index 3*d* are virtually extended, such virtual lines do not cross the inclined contour lines 4*r*, 4*r* of the second index 4*d*. As a result, the viewer easily images a condition that the lines extend parallel to the both side edges (the radial contour lines 4*i*, 4*j*) of the rectangular portion 4*e* in the second index 4*d*. In this case, with regard to two pairs of the parallel lines (i.e. a pair of the radial contour lines 3*i*, 4*i*, and a pair of the radial contour lines 3*j*, 4*j*), the viewer easily recognizes difference between the distance between the one pair of the parallel lines and the distance between the other pair of the parallel lines compared to the case shown in FIG. 4 where the width W2 of the rectangular portion 4*e* in the second index 4*d* is slightly narrower than the width W1 of the first index 3*d*.

Even in the above case, the displacement between the first indices 3*d* and the second indices 4*d* becomes inconspicuous since the trapezoidal portion 4*f* is provided between the rectangular portion 4*e* of the second index 4*d* and the first index 3*d*. In other words, the radial distance between the radial contour line 3*i* and the radial contour line 4*i* is separated by the trapezoidal portion 4*f* provided between the radial contour lines 3*i*, 4*i*, so that comparison of the position of the radial contour line 3*i* to the position of the radial contour line 4*i* can be avoided. Further, the displacement between the trapezoidal portion 4*f* and the radial contour line 3*i* or the radial contour line 4*i* can hardly be recognized since the contour lines 4*r*, 4*r* which form the trapezoidal portion 4*f* are not parallel to the radial contour line 3*i* and the radial contour line 4*i*. The above descriptions are also applied to the relation between the radial contour lines 3*j*, 4*j* and the trapezoidal portion 4*f*.

As described above, in the wristwatch 1 of the present embodiment, the virtual lines VL, VL extended from the radial contour lines 3*i*, 3*j* of the first index 3*d* cross the inclined contour lines 4*r*, 4*r* of the second index 4*d*, so that the viewer can hardly image a condition that the virtual lines extend to the radial contour lines 4*i*, 4*j* of the rectangular portion 4*e* in the second index 4*d*. This makes the displacement more inconspicuous.

The above displacement would become conspicuous if the width W3 of the trapezoidal portion 4*f* is equal to or narrower than the width W1 of the first index 3*d* to form a trapezoid with a shorter lower base, while the width of the rectangular portion in the second index 4*d* remains as the width W2. In other words, setting the width W3 of the trapezoidal portion 4*f* as described above, the contour lines 4*r*, 4*r* in the trapezoidal portion 4*f* inclines toward a center in the width direction as it gets closer to the center C1. The trapezoid having the shorter lower base than the upper base tapers like an arrow head. Accordingly, the trapezoidal portion 4*f* having the arrow head shape points at a portion displaced from the center in the width direction when the above displacement occurs. As a result, the displacement can be easily recognized.

In addition, as shown in FIG. 1, the indices (i.e. the first indices 3*d*', the second index 4*d*') corresponding to the twelve o'clock position have similar configurations and cause similar effects as the indices (i.e. the first index 3*d*, the second index 4*d*) corresponding to the other hour positions, but differ from the indices at the other hour positions only in terms of details of the configuration.

Here, the first indices 3*d*' of the dial plate 3 at the twelve o'clock position may be regarded as the indices consisting of the two first indices 3*d*, 3*d* arranged along the direction perpendicular to the radial line L. However, the first indices 3*d*' may be regarded as a single rectangular first index 3*d*' having a width more than twice as wide as that of the first index 3*d* and including a concave cutout 3*s* in the center of the width.

Similarly, the second indices 4*d*' of the case ring 4 at the twelve o'clock position may be regarded as a single bigger second index 4*d*' having a width more than twice as wide as that of the second index 4*d* and including a convex bar 4*z* in the center of the width.

It can be said that the first index 3*d*' and the second index 4*d*' regarded as described above have the same configuration as the indices corresponding to the other hour positions. Specifically, the first index 3*d*' is configured to protrude toward the crystal 5 from the surface of the dial plate 3. On the other hand, in the second index 4*d*' of the case ring 4 at the twelve o'clock position, the rectangular portion is formed as a concave groove relative to the upper surface 4*g* of the case ring 4 except the bar in the center of the width, and the trapezoidal portion has a space or cutout formed by cutting out the eave 4*c* in the height direction H. The width of the lower base of the trapezoidal portion in the second index 4*d*' is wider than the width of the first index 3*d*', and the width of the rectangular portion in the second index 4*d*' is narrower than that of the first index 3*d*'.

Accordingly, the first index 3*d*' differs from the first indices 3*d* at the other hour positions in that the cutout 3*z* is provided in the center of the width direction. The second index 4*d*' differs from the second indices 4*d* at the other hour positions in that the bar 4*z* is provided in the center of the width direction. However, even with the above differences, common configurations of the first and second indices 3*d*', 4*d*' with the indices (i.e. the first indices 3*d* and the second indices 4*d*) at the other hour positions can make the displacement in the circumferential direction between the first indices 3*d*' and the second indices 4*d*' inconspicuous. The indices (i.e. the first index 3*d*' and the second index 4*d*') at the twelve o'clock position may have the same configuration as the indices (i.e. the first indices 3*d* and the second indices 4*d*) at the other hour positions.

In the timepiece according to the present disclosure, the width W2 of the end (the distal end) in the second index 4*d* further away from the first index 3*d* may not be narrower than the width W1 of the end (the proximal end 3*k*) of the first index 3*d* closer to the second index 4*d*, but the width W2 of the second index 4*d* may be equal to or wider than the width W1 of the first index 3*d*.

Further, in the wristwatch 1 of the present embodiment, the second indices 4*d* are separated from the first indices 3*d* in the height direction H and located above the first indices 3*d* as shown in FIGS. 2, 3, and the second indices 4*d* are disposed not to overlap the first indices 3*d* in the plan view as shown in FIG. 4. Accordingly, the viewer feels that the indices 3*d*, 4*d* are spatially displaced when viewed in a line of sight in an oblique direction with respect to the dial plate 3 as shown in FIG. 3, so that the displacement can be inconspicuous even if the first index indices 3*d* and the second indices 4*d* are displaced in the circumferential direction.

In the timepiece according to the present disclosure, the second indices 4*d* may not be separated from the first indices 3*d* in the height direction H and may not be located above the first indices 3*d*, but the first indices 3*d* may be disposed in the same height as the second indices 4*d*. Further in the timepiece according to the present disclosure, the second indices 4*d* may not be disposed not to overlap the first indices 3*d* in the plan view shown in FIG. 4. Specifically, in the timepiece according to the present disclosure, the second indices 4*d* may be disposed to partially overlap the first indices 3*d* in the plan view. Note that the first indices 3*d* may overlap only the trapezoidal portions 4*f* of the second indices 4*d* in the plan view but may not overlap the rectangular portion 4*e*.

Moreover, in the wristwatch 1 of the present embodiment, each of the first indices 3*d* is formed to be convex in the height direction H, and each of the second indices 4*d* is formed to be concave in the height direction H as shown in FIGS. 2, 3. Accordingly, the viewer sees the side surfaces of indices 3*d*, 4*d* when viewed in a line of sight in an oblique direction with respect to the dial plate 3 as shown in FIG. 3, so that the radial contour lines 3*j*, 3*j*, 4*i*, 4*j* of the indices 3*d*, 4*d* in the plan view can hardly be identified. As a result, the displacement can be inconspicuous even if the first index indices 3*d* and the second indices 4*d* are displaced in the circumferential direction.

In addition, there are big differences in appearance between the radial contour lines 3*j*, 3*j* of the convex first index 3*d* and the radial contour lines 4*i*, 4*j* of the concave second index 4*d* when viewed in the line of sight in the oblique direction, so that the combination of the convex shape and the concave shape can makes the displacement more inconspicuous.

Note that in the timepiece according to the present disclosure, each of the first indices 3*d* may not be convex relative to the dial plate 3 in the height direction H, but may be provided in the same height as the surface of the dial plate 3 by printing or transfer printing, for example. Similarly, in the timepiece according to the present disclosure, each of the second indices 4*d* may not be concave relative to the upper surface 4*g* of the case ring 4 in the height direction H, but may be provided in the same height as the upper surface 4*g* of the case ring 4 by printing or transfer printing, for example. Alternatively, each of the second indices 4*d* may be convex from the upper surface 4*g* in the height direction H as the first index 3*d*. It is preferable not to form the first index 3*d* and the second index 4*d* flat but to form at least one of the first index 3*d* and the second index 4*d* stereoscopically (in a convex shape).

Further, in the wristwatch 1 of the present embodiment, the case ring 4 includes the eave 4*c* extending toward the center C1 of the dial plate 3 upwardly separated from the dial plate 3 in the height direction H as shown in FIGS. 2, 3. Accordingly, the eave 4*c* shades the incident light through the crystal 5 to cast a shadow on the dial plate 3. Thereby, the shadow gives a stereoscopic effect to the dial plate 3 on the appearance of the wristwatch 1. In addition, the eave 4*c* is cut out in a shape corresponding to the trapezoidal portion 4*f* of the second index 4*d*, so that a part of each first index 3*d* (especially, an outer circumferential portion) is not covered by the shadow cast on the dial plate 3 by the eave 4*c*. As a result, the first indices 3*d* can be seen with a clear impression and quality in appearance can be improved.

Note that in the timepiece according to the present disclosure, the eave 4*c* may not be cut out in the shape corresponding to the trapezoidal portion 4*f* of the second index 4*d*. In addition, the case ring 4 of the timepiece according to the present disclosure may not include the eave 4*c*. In this case, the timepiece may have a shape (a configuration in which the eave 4*c* does not substantially form an eave) in which the bottom surface of the eave 4*c* is extended downward in the height direction H (i.e. a direction approaching the upper surface of the dial plate 3) to the upper surface of the dial plate, or a shape in which the inner circumferential surface 4*a* is upwardly extended to the upper surface 4*g* to exclude the eave 4*c*, for example. In the case without the eave 4*c*, the trapezoidal portion 4*f* may be formed at the end (i.e. the proximal end 4*t*) of the rectangular portion 4*e* closer to the first index 3*d*.

Figure 5:
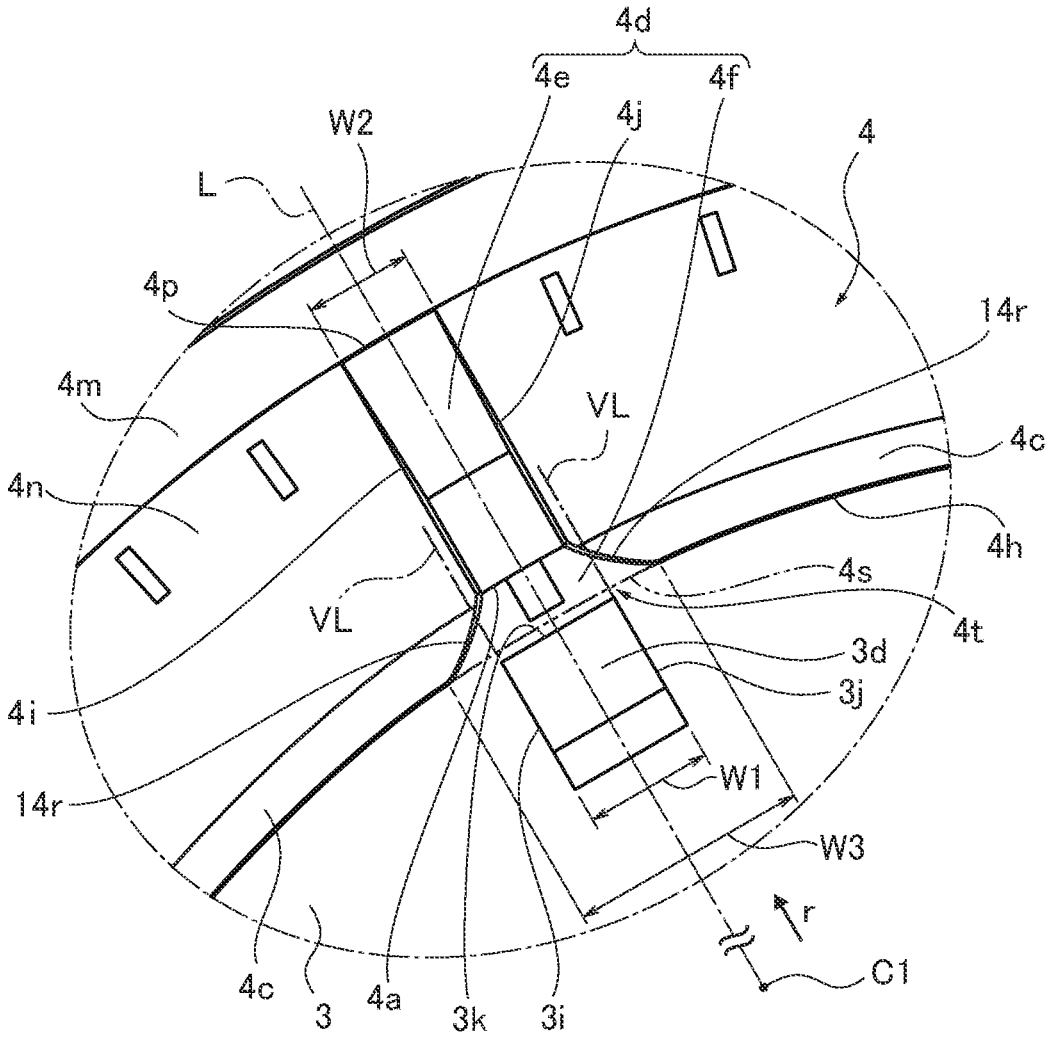
FIG. 5 is a plan view corresponding to FIG. 4 and illustrating another example of a wider portion in the second index.
Figure 6:
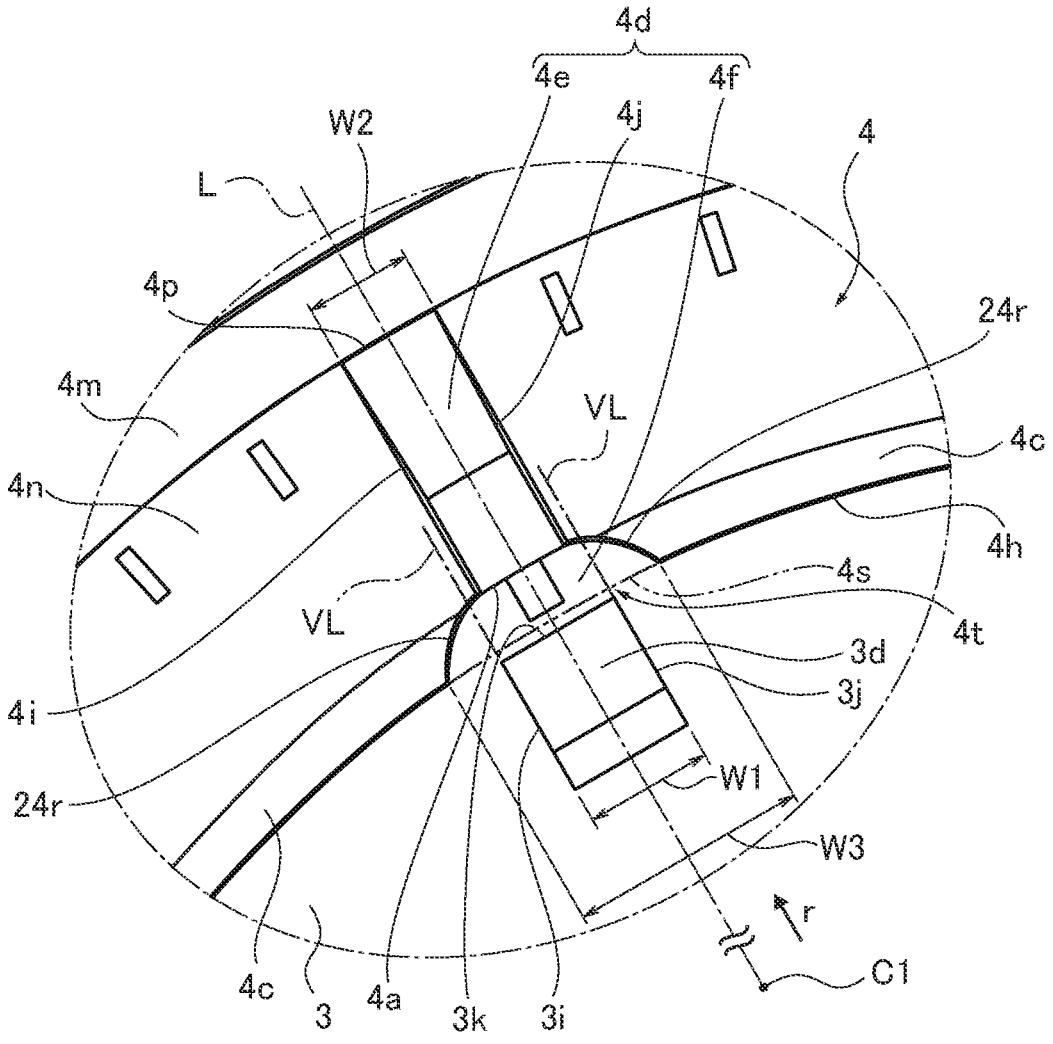
FIG. 6 is a plan view corresponding to FIG. 4 and illustrating yet another example of a wider portion in the second index.

In the wristwatch 1 of the present embodiment, the wider shape of the second index 4*d* is formed as the trapezoidal portion 4*f*, but the wider shape of the timepiece according to the present disclosure is not limited to the trapezoid. Specifically, in the trapezoidal portion 4*f*, the two contour lines 4*r*, 4*r* corresponding to the inclined legs of the trapezoid are straight but the two lines which forms the wider shape may be curved like an arc. For example, as shown in FIG. 5, contour lines 14*r*, 14*r* of the second index 4*d* may be curved and convex relative to the first index 3*d*. Alternatively, as shown in FIG. 6, contour lines 24*r*, 24*r* of the second index 4*d* may be curved and concave relative to the first index 3*d*. Note that in the alternative examples, the two contour lines may be symmetric or asymmetric relative to the radial line L.

Next, a second embodiment of the present disclosure will be described with reference to FIG. 7. Note that the same reference numerals are used to the same elements as those in the above embodiment, and redundant explanations are to be omitted. In this embodiment, first indices 33*d* and second indices 34*d* differ from the first indices 3*d* and the second indices 4*d* in the first embodiment. Specifically, each of the second indices 34*d* includes a first rectangular portion 34*e* and a second rectangular portion (the wider portion) 34*f* to form a substantially T-shaped index. The first rectangular portion 34*e* is disposed outward in the radial direction r and extends along the radial line L. The second rectangular portion (a wider portion) 34*f* is disposed inward in the radial direction r and extends in a direction perpendicular to the radial line L. The first rectangular portion 34*e* is the same as the rectangular portion 4*e* in the first embodiment. The second rectangular portion 34*f* is formed in the eave 4*c*. The second rectangular portion 34*f* includes first contour lines 34*v*, 34*w* and second contour lines 34*x*, 34*y* at each side thereof. The first contour lines 34*v*, 34*w* are perpendicular to the radial line L. The second contour lines 34*x*, 34*y* are parallel to the radial line L and perpendicular to the first contour lines 34*v*, 34*w*. One end of each first contour line 34*v*, 34*w* is connected to a radially inner end of each contour line 34*i*, 34*j* in the first rectangular portion 34*e*, and the other end is connected to a radially outer end of each second contour line 34*x*, 34*y*, respectively.

Figure 7:
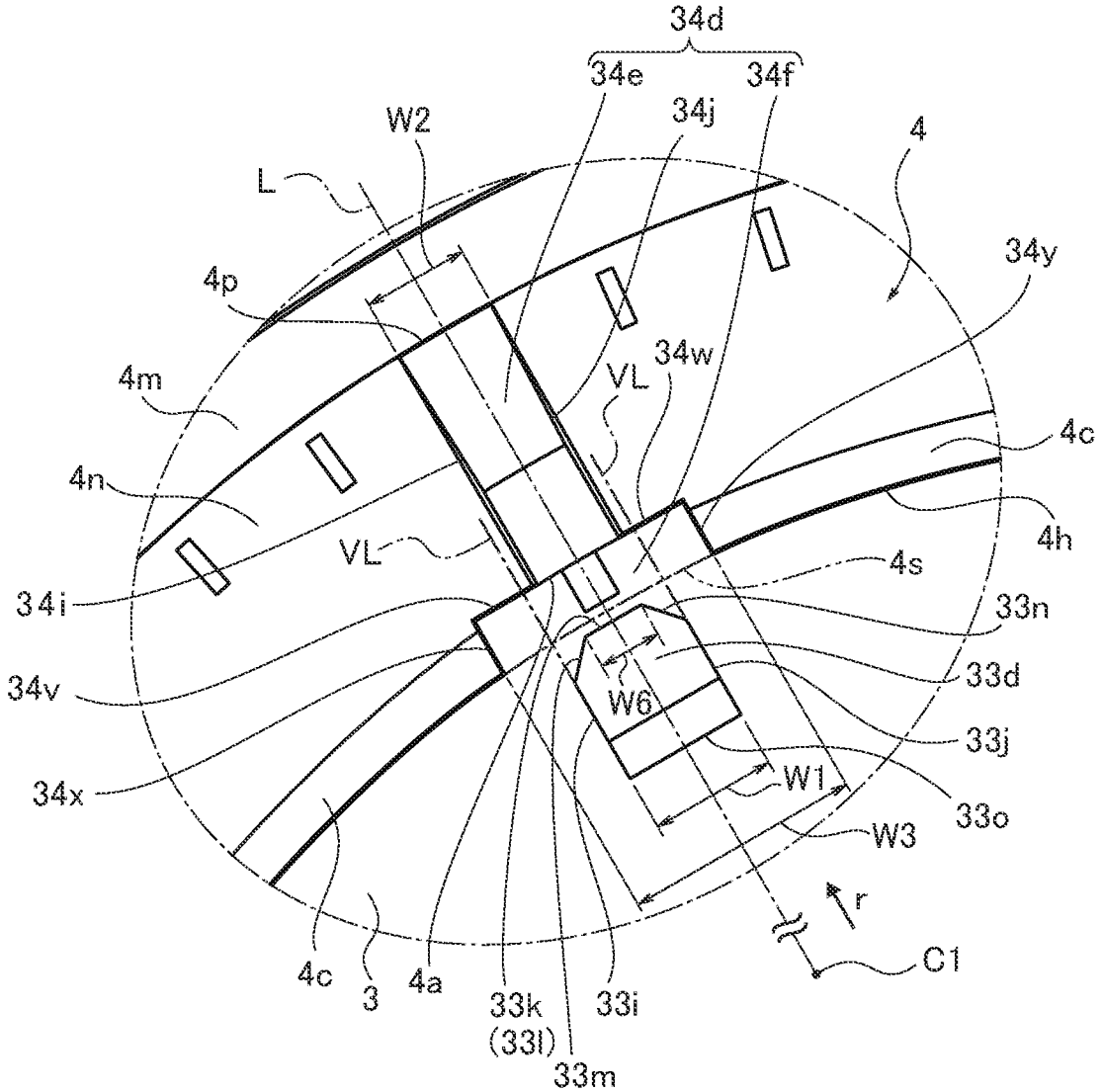
FIG. 7 is a plan view illustrating a first index and a second index according to a second embodiment of the present disclosure and corresponding to FIG. 4.

Each of the first indices 33*d* includes contour lines 33*i*, 33*j*, 331, 33*m*, 33*n*, 33*o* to form a hexagonal shape in the plan view of FIG. 7. The contour lines 33*i*, 33*j* correspond to the radial contour lines 3*i*, 3*j* in the first embodiment, and extends parallel to the radial line L and the second contour lines 34*x*, 34*y* of the second index 34*d*. The contour line 33*l* at a proximal end 33*k* faces the second index 34*d* and extends parallel to the first contour lines 34*v*, 34*w* of the second index 34*d*. Similarly, the contour line 33*o* at the distal end extends parallel to the first contour lines 34*v*, 34*w*. The contour line 33*m* is disposed between the contour line 33*l* and the contour line 33*i*, and the contour line 33*n* is disposed between the contour line 33*i* and the contour line 33*j*. The contour lines 33*m*, 33*n* are inclined relative to the second contour lines 34*x*, 34*y* of the second index 34*d* and the radial line L. In other words, the two contour lines 33*m*, 33*n* are placed at a side of the first index 33*d* facing the second index 34*d*. Accordingly, the first index 33*d* is tapered toward the second index 34*d*, and a width W6 of the contour line 33*l* at the proximal end 33*k* is smaller than the width W1 between the contour lines 33*i*, 33*j*. The width W6 of the first index 33*d* is the substantially same as the width W2 of the first rectangular portion 34*e* in the second index 34*d* but slightly narrower than the width W2.

According to the second embodiment, the second rectangular portion 34*f* of the second index 34*d* is located between the contour lines 33*i*, 33*j* of the first index 33*d* and the contour lines 34*i*, 34*j* of the second index 34*d*. Further, the contour lines 33*m*, 33*n* of the first index 33*d* are inclined relative to the second contour lines 34*x*, 34*y* and do not extend parallel to the second contour lines 34*x*, 34*y*. Accordingly, the viewer can hardly recognize the amount of the displacement in the circumferential direction between the virtual lines VL, VL extended from the contour lines 33*i*, 33*j* of the first index 33*d* and the lines extended from the contour lines 34*i*, 34*j* of the second index 34*d*. Also, the viewer can hardly recognize the amount of the displacement in the circumferential direction between the contour lines 33*i*, 33*j* of the first index 33*d* and the contour lines 34*x*, 34*y* of the second index 34*d*.

Figure 8:
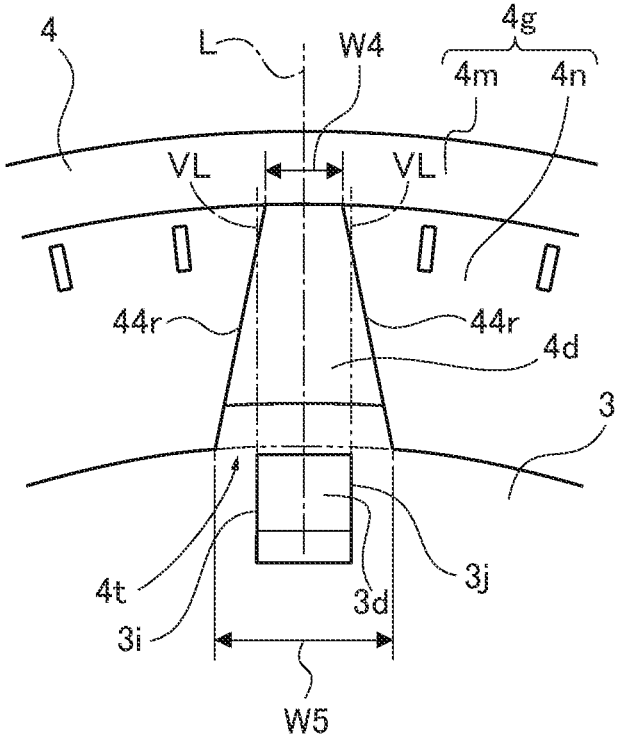
FIG. 8 is a plan view corresponding to FIG. 4 and illustrating another example of a second index.

Alternatively, in the timepiece according to the present disclosure, the second index 4*d* shown in FIG. 1 to FIG. 6 may not include the rectangular portion 4*e* and the trapezoidal portion 4*f* FIG. 8 is a plan view corresponding to FIG. 4 and illustrates another embodiment wherein the second index 4*d* does not include the rectangular portion 4*e*, and the entire second index 4*d* is configured from a trapezoidal portion having a shape which becomes wider as it approaches the first index 3*d*. In the embodiment shown in FIG. 8, the second index 4*d* is entirely configured in a trapezoid shape. The second index 4*d* includes contour lines 44*r*, 44*r* which are inclined relative to the radial line L and correspond to the two inclined legs of the trapezoid. The two contour lines 44*r*, 44*r* extend toward the first index 3*d*. In the embodiment shown in FIG. 8, a width W4 of a portion corresponding to the upper base of the trapezoid has the same size as the width W2 of the rectangular portion 4*e* shown in FIG. 4 and a width W5 of a portion (i.e. the proximal end 4*t*) corresponding to the lower base of the trapezoid has the same size as the width W3 of the trapezoidal portion 4*f* shown in FIG. 4, for example. In other words, the width of the second index 4*d* gradually increases from the distal end to the proximal end 4*t*. The virtual lines VL, VL, which are extended from the radial contour lines 3*i*, 3*j* of the first index 3*d* toward the second index 4*d*, cross the inclined contour lines 44*r*, 44*r*. According to this embodiment, the viewer can hardly recognize the amount of the displacement in the circumferential direction between the first index 3*d* and the second index 4*d* since the radial contour lines 3*i*, 3*j* of the first index 3*d* and the inclined contour lines 44*r*, 44*r* of the second index 4*d* are not parallel to each other.

Figure 9:
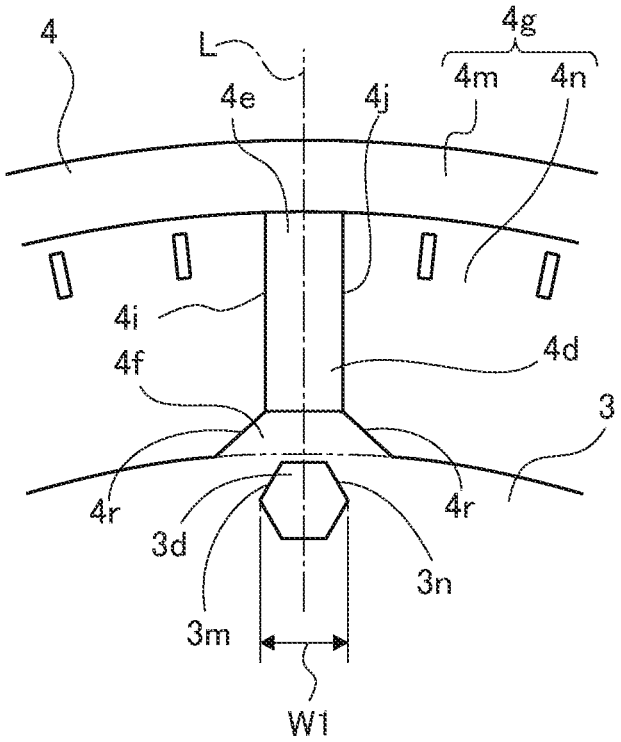
FIG. 9 is a plan view corresponding to FIG. 4 and illustrating another example of a first index.

Similarly, in the timepiece according to the present disclosure, the first indices 3*d*, 33*d* are not limited to the rectangular shape. FIG. 9 corresponds to FIG. 4 and illustrates yet another embodiment wherein a first index 3*d* is a hexagon. In the timepiece according to the present disclosure, as shown in FIG. 9, the first index 3*d* may be entirely configured in a shape other than rectangular such as trapezoidal, polygonal, circular, star and the like. In this case, the width W1 of the first index 3*d* has the maximum dimension along a direction perpendicular to the radial line L. In the embodiment shown in FIG. 9, the first index 3*d* has a hexagon shape, and includes contour lines 3*m*, 3*n* inclined relative to the radial line L. The inclined contour lines 3*m*, 3*n* are placed to face the inclined contour lines 4*r*, 4*r* of the trapezoidal portion 4*f* in the second index 4*d*. However, the inclined contour lines 3*m*, 3*n* of the first index 3*d* and the inclined contour lines 4*r*, 4*r* of the second index 4*d* are not parallel to each other. Further, none of the contour lines which define the first index 3*d* are parallel to the inclined contour lines 4*r*, 4*r* of the trapezoidal portion 4*f* According to the embodiment shown in FIG. 9, the viewer can hardly recognize the amount of the displacement in the circumferential direction between the first index 3*d* and the second index 4*d*.

Further, the wristwatch 1 of the present embodiment can adopt the design wherein the second indices 4*d*, 34*d* are longer than the first indices 3*d*, 33*d* along the radial line L because of the effect that the displacement in the circumferential direction between the first indices 3*d*, 33*d* and the second indices 4*d*, 34*d* can hardly be recognized. Moreover, the first indices 3*d*, 33*d* and the second indices 4*d*, 34*d* can be arranged in series to form relatively longer indices along the radial line L because of the design wherein the second indices 4*d*, 34*d* are longer than the first indices 3*d*, 33*d*, which can give an impression which makes the indices noticeable and distinguishing.

The timepiece according to the present disclosure is not limited to one wherein the length of the second indices 4*d*, 34*d* along the radial line L is longer than that of the first indices 3*d*, 33*d*, but the length of the second indices 4*d*, 34*d* along the radial line L may be equal to or shorter than that of the first indices 3*d*, 33*d*.

In addition, the above effect of the present embodiment can be obtained by a general wristwatch having no bezel and the like since the second indices 4*d*, 34*d* are provided on the case ring 4 in the wristwatch 1.

Note that in the timepiece according to the present disclosure, the circular member is not limited to the case ring 4 of the wristwatch 1 in the above embodiments, but in a timepiece without the case ring 4, the bezel, the case 2 or the like may be the circular member. In this case, the second indices 4*d*, 34*d* may be disposed in the bezel or the case 2. Particularly, it is effective for a timepiece in which the rotatable bezel having a click mechanism is attached to the case, and the bezel stops at positions where the indices of the dial plate face the indices of the bezel. This is because such a timepiece has more parts for the rotation mechanism, it can be easily affected by accumulation of tolerances of the parts, which make it difficult to precisely set the position where the rotation of the bezel stops, and the indices of the bezel may easily be misaligned relative to the indices of the dial plate.

In addition, the circular member in the timepiece according to the present disclosure may not necessarily be a complete ring but may be an incomplete ring having at least one cutout. In short, the circular member in the timepiece according to the present disclosure may not be a completely connected ring as long as the circular member is disposed in the outer circumferential portion of the dial plate or radially outward of the dial plate and is arranged relative to at least the first indices in series.

Further, the indices (the first index and the second index) of the present disclosure may not be applied to all indices (the first index 3*d*, the second index 4*d*) corresponding all hours like the wristwatch 1, but may only be applied to some noticeable indices (indices corresponding to twelve o'clock, three o'clock, six o'clock, nine o'clock, for example).

Alternatively, the indices of the present disclosure may be applied to some of indices which are easily displaced or misaligned. Specifically, for example, when the case ring 4 is set to the case 2 of the wristwatch 1 based on the twelve o'clock position of the case ring 4 (the twelve o'clock position of the case ring 4 is set to correspond to a predetermined position of the case 2 (a position corresponding to twelve o'clock)), and the displacement is likely to occur at the six o'clock position opposite to the twelve o'clock position with the center C1 therebetween, the present disclosure may be applied at least to the index at the six o'clock position.

The above embodiments are applied to the wristwatch as an example of the timepiece according to the present disclosure. However, the timepiece according to the present disclosure is not limited to the wristwatch but may be applied to portable watches such as a pocket watch and other types of watches such as non-portable watches.

What is claimed is:

1. A timepiece comprising:

a dial plate comprising a first index on a radial line outwardly extending from a center; and a circular member disposed outside of the dial plate and extending at least partially circularly, the circular member comprising a second index arranged in series with the first index on the radial line, wherein the second index comprises a proximal end facing the first index; and a distal end opposite the proximal end, wherein a width of the proximal end is wider than that of the distal end in a plan view as seen in a height direction of the dial plate, wherein the width of the proximal end of the second index is wider than that of a proximal end of the first index facing the second index, wherein the second index comprises a rectangular portion extending along the radial line in the plan view, and a wider portion at the proximal end, and wherein a width of the wider portion gradually increases toward the first index.

2. The timepiece according to claim 1, wherein at least one of the first index and the second index comprises, on a side facing the other of the first index and the second index, an inclined contour line relative to the radial line and provided each side of the radial line.

3. The timepiece according to claim 1, wherein the second index comprises, on at least a side facing the first index, an inclined contour line relative to the radial line and provided each side of the radial line, wherein the first index comprises a contour line provided each side of the radial line and extending parallel to the radial line, and wherein virtual lines extended from the contour lines of the first index toward the second index cross the inclined contour lines of the second index.

4. The timepiece according to claim 1, wherein a width of the second index gradually increases from the distal end to the proximal end.

5. The timepiece according to claim 1, wherein the second index is separated upward in the height direction from the first index, and wherein the second index is disposed not to overlap the first index in the plan view.

6. The timepiece according to claim 1, wherein a length of the second index along the radial line is longer than that of the first index.

7. The timepiece according to claim 1, wherein the circular member is a case ring.

8. A timepiece comprising:

a dial plate comprising a first index on a radial line outwardly extending from a center; and a circular member disposed outside of the dial plate and extending at least partially circularly, the circular member comprising a second index arranged in series with the first index on the radial line, wherein the second index comprises a proximal end facing the first index; and a distal end opposite the proximal end, wherein a width of the proximal end is wider than that of the distal end in a plan view as seen in a height direction of the dial plate, wherein the width of the proximal end of the second index is wider than that of a proximal end of the first index facing the second index, wherein the second index comprises, on at least a side facing the first index, an inclined contour line relative to the radial line and provided each side of the radial line, wherein the first index comprises a contour line provided each side of the radial line and extending parallel to the radial line, and wherein virtual lines extended from the contour lines of the first index toward the second index cross the inclined contour lines of the second index, wherein the inclined contour lines of the second index are curved and convex relative to the first index.

9. The timepiece according to claim 8, wherein a width of the second index gradually increases from the distal end to the proximal end.

10. The timepiece according to claim 8, wherein at least one of the first index and the second index comprises, on a side facing the other of the first index and the second index, an inclined contour line relative to the radial line and provided each side of the radial line.

11. The timepiece according to claim 8, wherein the second index comprises, on at least a side facing the first index, an inclined contour line relative to the radial line and provided each side of the radial line, wherein the first index comprises a contour line provided each side of the radial line and extending parallel to the radial line, and wherein virtual lines extended from the contour lines of the first index toward the second index cross the inclined contour lines of the second index.

12. The timepiece according to claim 8, wherein the second index is separated upward in the height direction from the first index, and wherein the second index is disposed not to overlap the first index in the plan view.

13. The timepiece according to claim 8, wherein a length of the second index along the radial line is longer than that of the first index.

14. The timepiece according to claim 8, wherein the circular member is a case ring.

15. A timepiece comprising:

a dial plate comprising a first index on a radial line outwardly extending from a center; and a circular member disposed outside of the dial plate and extending at least partially circularly, the circular member comprising a second index arranged in series with the first index on the radial line, wherein the second index comprises a proximal end facing the first index; and a distal end opposite the proximal end, wherein a width of the proximal end is wider than that of the distal end in a plan view as seen in a height direction of the dial plate, and wherein the width of the proximal end of the second index is wider than that of a proximal end of the first index facing the second index, wherein the second index comprises, on at least a side facing the first index, an inclined contour line relative to the radial line and provided each side of the radial line, wherein the first index comprises a contour line provided each side of the radial line and extending parallel to the radial line, and wherein virtual lines extended from the contour lines of the first index toward the second index cross the inclined contour lines of the second index, wherein the inclined contour lines of the second index are curved and concave relative to the first index.

16. A timepiece comprising:

a dial plate comprising a first index on a radial line outwardly extending from a center; and a circular member disposed outside of the dial plate and extending at least partially circularly, the circular member comprising a second index arranged in series with the first index on the radial line, wherein the second index comprises a proximal end facing the first index; and a distal end opposite the proximal end, wherein a width of the proximal end is wider than that of the distal end in a plan view as seen in a height direction of the dial plate, wherein the width of the proximal end of the second index is wider than that of a proximal end of the first index facing the second index, wherein at least one of the first index and the second index comprises, on a side facing the other of the first index and the second index, an inclined contour line relative to the radial line and provided each side of the radial line, and wherein the second index comprises:

a first rectangular portion extending along the radial line in the plan view; and a second rectangular portion provided at the proximal end and extending perpendicular to the radial line in the plan view, and wherein the first index comprises the inclined contour lines are provided on a side facing the second index.

17. A timepiece comprising:

a dial plate comprising a first index on a radial line outwardly extending from a center; and a circular member disposed outside of the dial plate and extending at least partially circularly, the circular member comprising a second index arranged in series with the first index on the radial line, wherein the second index comprises a proximal end facing the first index; and a distal end opposite the proximal end, wherein a width of the proximal end is wider than that of the distal end in a plan view as seen in a height direction of the dial plate, and wherein the width of the proximal end of the second index is wider than that of a proximal end of the first index facing the second index, wherein a width of the distal end in the second index is equal to or narrower than that of the proximal end of the first index.

18. A timepiece comprising:

a dial plate comprising a first index on a radial line outwardly extending from a center; and a circular member disposed outside of the dial plate and extending at least partially circularly, the circular member comprising a second index arranged in series with the first index on the radial line, wherein the second index comprises a proximal end facing the first index; and a distal end opposite the proximal end, wherein a width of the proximal end is wider than that of the distal end in a plan view as seen in a height direction of the dial plate, wherein the width of the proximal end of the second index is wider than that of a proximal end of the first index facing the second index, wherein the first index is flat or convex in the height direction, and the second index is concave in the height direction.

19. A timepiece comprising:

a dial plate comprising a first index on a radial line outwardly extending from a center; and a circular member disposed outside of the dial plate and extending at least partially circularly, the circular member comprising a second index arranged in series with the first index on the radial line, wherein the second index comprises a proximal end facing the first index; and a distal end opposite the proximal end, wherein a width of the proximal end is wider than that of the distal end in a plan view as seen in a height direction of the dial plate, wherein the width of the proximal end of the second index is wider than that of a proximal end of the first index facing the second index, wherein the second index is separated upward in the height direction from the first index, wherein the second index is disposed not to overlap the first index in the plan view, wherein the second index comprises a rectangular portion extending along the radial line in the plan view, and a wider portion comprising the proximal end, wherein the circular member comprises an eave separated upward in the height direction from the dial plate and extending toward the center of the dial plate, and wherein the eave is cut out in a shape corresponding to that of the wider portion.

20. A timepiece comprising:

a dial plate comprising a first index on a radial line outwardly extending from a center; and a circular member disposed outside of the dial plate and extending at least partially circularly, the circular member comprising a second index arranged in series with the first index on the radial line, wherein the second index comprises a proximal end facing the first index; and a distal end opposite the proximal end, wherein a width of the proximal end is wider than that of the distal end in a plan view as seen in a height direction of the dial plate, wherein the width of the proximal end of the second index is wider than that of a proximal end of the first index facing the second index, wherein at least one of the first index and the second index comprises, on a side facing the other of the first index and the second index, an inclined contour line relative to the radial line and provided each side of the radial line, wherein the first index comprises the inclined lines on a side facing the second index and the second index comprises the inclined lines on a side facing the first index, and wherein the inclined lines of the first index are not parallel to the inclined lines of the second index.

* * * * *